United States Patent [19]

Rieger

[11] 4,143,836

[45] Mar. 13, 1979

[54] METHOD AND DEVICE FOR SPREAD BOMBING

[75] Inventor: Ulrich Rieger, Westerham, Fed. Rep. of Germany

[73] Assignee: Messerschmitt-Bölkow-Blohm GmbH, Fed. Rep. of Germany

[21] Appl. No.: 717,660

[22] Filed: Aug. 25, 1976

[30] Foreign Application Priority Data

Aug. 30, 1975 [DE] Fed. Rep. of Germany ..... 2538665

[51] Int. Cl.[2] ..... F41G 7/10; F42B 15/10; F42B 15/02; F42B 15/16

[52] U.S. Cl. ..... 244/3.15; 102/3

[58] Field of Search ..... 244/3.1, 3.15; 102/72, 102/3

[56] References Cited

U.S. PATENT DOCUMENTS

| | | | |
|---|---|---|---|
| 3,093,072 | 6/1963 | Pigman | 102/7.2 |
| 3,276,367 | 10/1966 | Edwards | 102/7.2 |
| 3,749,333 | 7/1973 | Lykken et al. | 244/3.15 |
| 4,013,875 | 3/1977 | McGlynn | 244/3.15 |

*Primary Examiner*—Samuel W. Engle
*Assistant Examiner*—Thomas H. Webb
*Attorney, Agent, or Firm*—McGlew and Tuttle

[57] ABSTRACT

The spread bombing is effected by a plurality of guided bombs transported by a carrier aircraft near to a target area. The guided bombs are provided with respective programmable storage devices and a freely selectable target coverage pattern is provided by supplying the storage devices with selected different respective guide programs which can be adjusted, both on the ground, prior to an attack on a target area, and in the carrier aircraft, during the attack, as a function of the locating of the target and the preselected target coverage pattern. The different guide programs are transformed into respective different guide commands which are stored in the respective storage devices of the individually guided bombs. The bombs are simultaneously released from the carrier aircraft and the stored guide commands guide the respective bombs into different respective trajectories so that the bombs strike the target area in a predetermined coverage density corresponding to the selected target coverage pattern. The carrier aircraft carries a weapon computer by which the aircraft can be brought into a flight position predeterminable by the weapon computer for simultaneous release of the guided bombs.

4 Claims, 4 Drawing Figures

METHOD AND DEVICE FOR SPREAD BOMBING

FIELD AND BACKGROUND OF THE INVENTION

The present invention relates to a method and a device for spread bombing with bombs with are transported by a carrier aircraft near to a target area.

The effective range of conventional, non-guided bombs is of the same order of magnitude as the trajectory error, and that is why the probability of success, namely, the destruction of the target with such bombs, is limited. A possible solution is the use of larger calibers which result in an increase of the effective range. In this respect, it is disadvantageous that the increase of the destroyed area is less than proportional to the increased explosive charge. Particularly for hard targets, thus small effective radii, very large bombs are needed for a sufficient probability of destruction. Therefore, in modern strategy, a greater use of so-called spread weapons is provided, with which larger areas can be covered with smaller explosive charges and as uniformly as possible, in order to reach the so-called static probability of hitting.

DESCRIPTION OF THE PRIOR ART

It is known, for example, from U.S. Pat. No. 2,809,583, to accommodate a plurality of smaller bombs in a receptacle which, upon release from the carrier aircraft, is pyrotechnically disassembled through a time igniter, thus permitting scattering of the small bombs over a large area. In such a method, the extension of the covered area depends on many accidental factors, such as the speed of the carrier aircraft, the prevailing wind velocity, the position occupied by the receptacle at the instant of disassembly, and the like. This is disadvantageous, particularly if a definite coverage density is necessary for destroying an attacked target or putting it out of action.

To improve efficiency, it is further known to reduce the trajectory error of the individual dropped bombs. To this end, it is necessary to provide the bombs with guide devices by means of which they can be guided to the target from a carrier aircraft, manually or even automatically. Such automatic guide devices for individually dropped bombs are well known. They either steer for definite, specific, properties of the target, for example, an electromagnetic radiation of the target, which leads to a high accuracy of hitting but requires expensive guide devices, or they steer blindly, in accordance with a preset program, which is possible with relatively inexpensive guide devices but does not lead to an accuracy in hitting.

SUMMARY OF THE INVENTION

The present invention is directed to a method of spread bombing, with which the coverage density for a selected target, particularly a so-called hard area target, can be determined from the carrier aircraft.

Starting from a method of the kind mentioned above, it is provided, in accordance with the invention, that there is used a plurality of guided bombs which are equipped with programmable storage devices, that the target coverage pattern obtainable with the storage devices is freely selectable through different guide programs which can be adjusted, both on the ground, prior to the attack, and in the carrier aircraft, during the attack, as a function of the locating of the target and the preselected coverage pattern, and which are transformed into different guide commands and stored in the storage devices of the individual guided bombs, and that, upon their simultaneous release, the bombs are guided by the stored guide commands into different trajectories, in a manner such that they hit the area target in a predetermined coverage density.

Since, as a rule, modern high-performance military and naval aircraft are equipped with so-called weapon computers into which all information on the flight conditions of the carrier aircraft, the target positions relative to the aircraft, and similar data are entered and stored therein up to an output or new input, it suffices to store therein also the guidance characteristics of the individual bombs, as an additional information, to enter the desired coverage pattern and to provide a further computer program by which the control programs for the bombs, in the form of critical measured values at which the rudder deflections of the bombs is to be returned again to zero, are determined from the respective actual measured values and the desired coverage about the target point.

For a programmable steering, in accordance with the invention, the bombs are provided with a measuring device, a storage for the enterable critical measured values, a switch which is released as soon as the entered measured values are attained and which is connected to a power accumulator by which the rudders of the guided bombs are returned to their zero position, the rudders themselves, and a connection for the input of the measured values.

Another advantage of the invention is that the method makes it possible to reach targets which are not, or only hardly, accessible ballistically and to fight them accurately with a predetermined coverage pattern and inexpensive means, and, upon attaining the pre-programmed measured values, to change the motion of the bombs from guided flight into a ballistic flight. The possibility of defense both against the spread weapons and the carrier aircraft transporting the weapons to the target is thereby strongly reduced. In addition, due to the precision bombing, a substantial reduction of the amount of weapons, as compared to non-guided spread weapons, is made possible. Finally, the control devices of the bombs used with this method are substantially less expensive than those used with known guided bombs.

An object of the invention is to provide an improved method of spread bombing.

Another object of the invention is to provide an improved device for spread bombing.

A further object of the invention is to provide such a method and device with which the coverage density for a selected target can be determined from a bomb-carrying aircraft.

For an understanding of the principles of the invention, reference is made to the following description of a typical embodiment thereof as illustrated illustrated the accompanying drawings.

DESCRIPTION OF THE PREFERRED EMBODIMENT

Figure 2:
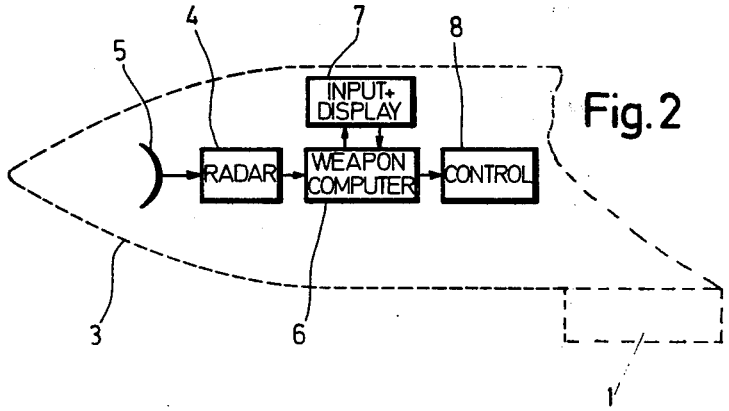
FIG. 2 is a block diagram of an aircraft carried device for carrying out the inventive method illustrated in FIG. 1.

In an indicated carrier aircraft 3 (see FIG. 2), there is provided a radar gear 4 serving the purpose of locating targets and equipped with an antenna 5, a so-called weapon computer 6 and an input and display device 7. Weapon computer 6 is connected to a control device 8 through which the bombs or bomblets (see also FIG. 3), which are suspended in receptacles 1 (here only indicated) of carrier aircraft 3, or even suspended individually from the aircraft, are adjusted with respect to their storages and released.

Each bomb 10 is designed as a so-called guided bomb, i.e., it is equipped with four rudders 11 to 14 which are locked in deflected position by means of pawls 15, 16 and 17. Each rudder is provided with a power accumulator comprising a return spring 18–20 by which the rudders can be returned into their rest position or zero position (not shown) under the effect of programmable time switches 21 and 22, which act as storages, and through the release of the pawls 15–17. The time switches acting as storages and, thereby, the pawls, are connected through connecting members 23 and 24 and through respective lines 25 and 26 to a connector 27 through which they may be electrically connected to control device 8.

As a matter of course, other storage devices may also be used. It is only important to have a possibility of storing the guide program, determined by weapon computer 7, in the bomb for the duration of the flight, and of obtaining it therefrom. Also, other rudder arrangements and other means for producing the control moment may be provided. For example, the rudders may be moved through servo-motors.

Figure 3:
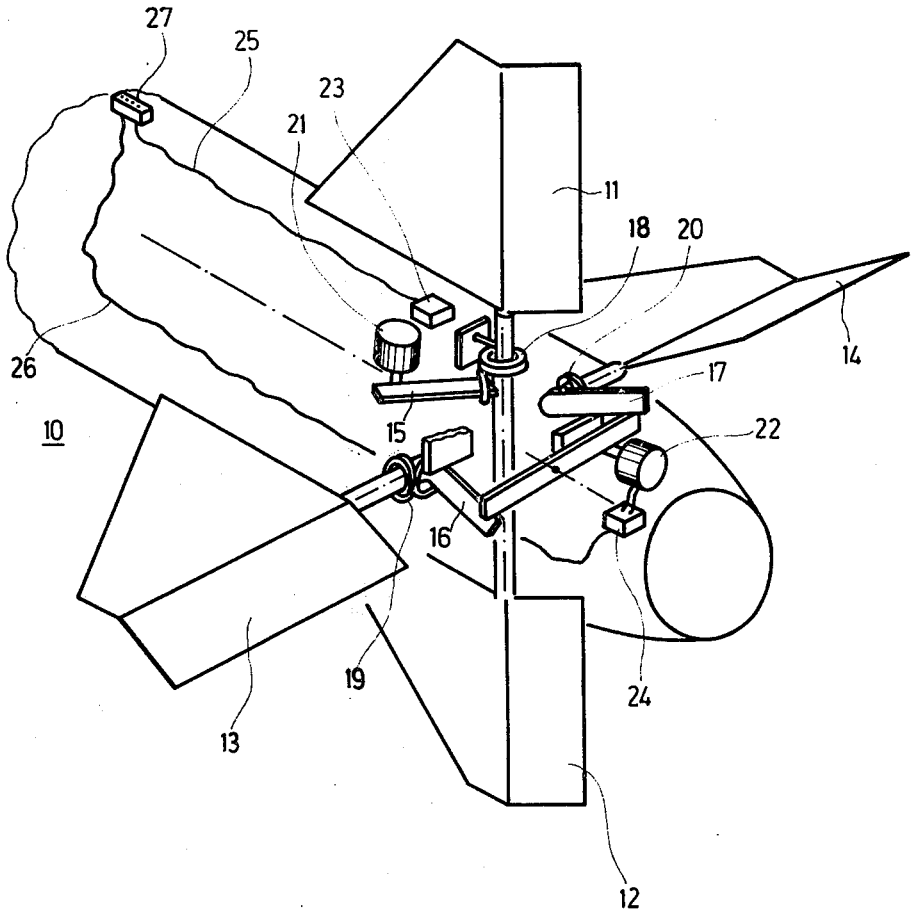
FIG. 3 is a perspective view of the steering devices of a guided bomb, provided for carrying out the inventive method.
Figure 4:
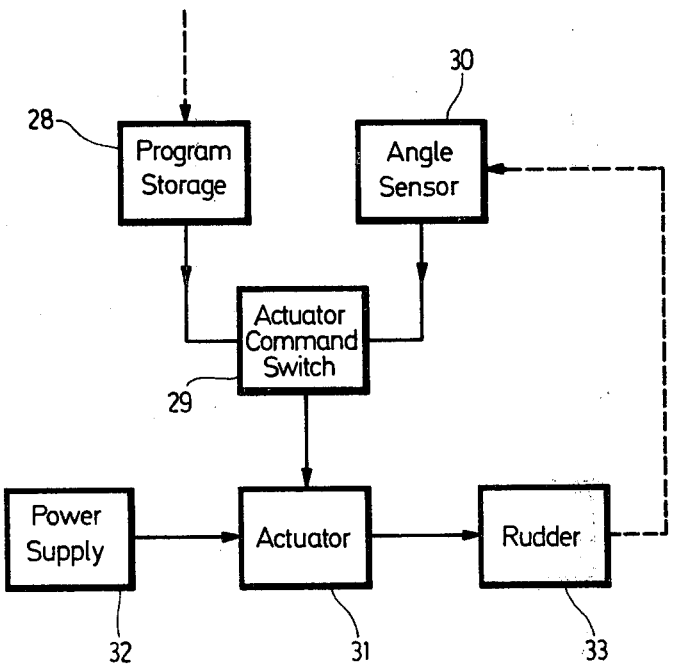
FIG. 4 is a block diagram of the control of the guided bomb.

As shown in FIG. 3, rudders 11 and 12 are actuated equidirectionally. They make the bomb follow the curvature of the trajectory, while the oppositely actuable rudders 13 and 14 determine the plane of the curvature. guided To make the illustration complete, FIG. 4 shows a block diagram of the command device of the guide bomb, for one plane. The command program determined by the carrier aircraft is stored in a program storage 28 which is followed by an actuator command switch 29. The command switch receives simultaneously the angular position of the bomb, which is picked up by an angle sensor 30. The command signal, formed of the command program and the data about the angular position, passes to an actuator 31 by which, with the use of a power accumulator 32, the associated rudder 33 is adjusted to the desired degree.

Figure 1:
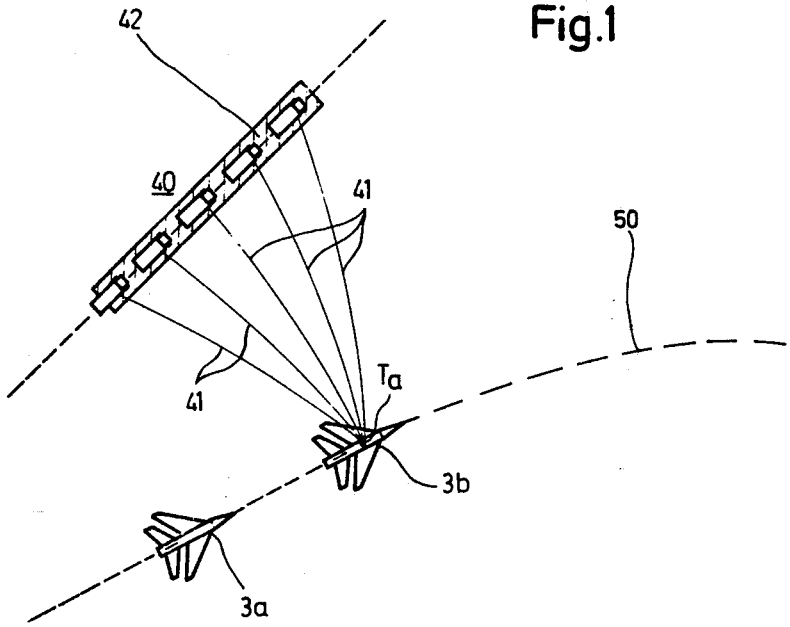
FIG. 1 diagrammatically shows the use of spread weapons in accordance with the invention.

The described device operates as follows:

As soon as the target to be attacked, for example, a train of vehicles 40, becomes distinguishable from the carrier aircraft or known through radio from a control station, the coordinates of location of the target are determined by means of the radar gear 4, approximately in a position 3*a* shown in FIG. 1, and supplied to the weapon computer 6. At the same time, the desired coverage pattern for target 42, here a drop in a row, is entered by the pilot of the carrier aircraft into the weapon computer 8, by means of input device 7. From these input data and from the information on the flight and steering properties of the guided bombs forming the spread weapon, on the flight altitude and speed of the carrier aircraft and, perhaps, the speed of the detected target, all stored in the weapon computer, the computer predetermines the sequence in time of the rudder deflections for the guided bombs so that the bombs, starting from a point of release T*a* in an aircraft position 3*b*, arrive at the end of their flight time, substantially uniformly distributed, at the located target. The pre-computed values are stored in the storage devices of the individual guided bombs. As soon as the carrier aircraft has reached position 3*b*, the guided bombs are released through the weapon computer. They move in accordance with the preadjusted values to target 40, while following different trajectories 41. On its own path of flight 50, the carrier aircraft escapes very rapidly from the range of action of defense weapons which might be operating in the target area.

Instead of computing the programmed instructions during the attack, it is possible, of course, to store the necessary guidance commands in the bombs in advance and to maneuver the aircraft into a release position which is suitable for the stored program.

While a specific embodiment of the invention has been shown and described in detail to illustrate the application of the principles of the invention, it will be understood that the invention may be embodied otherwise without departing from such principles.

What is claimed is:

1. A method of spread bombing with bombs transported by a carrier aircraft near to a target area, wherein a plurality of guided bombs are provided with respective programmable storage devices; comprising the steps of providing a freely selectable target coverage pattern by supplying the storage devices with selected different respective guide programs which can be adjusted, both on the ground, prior to an attack on a target area, and in the carrier aircraft, during the attack, as a function of the steps of locating the target and determining the preselected target coverage pattern; simultaneously transforming the respective different guide programs into respective different guide commands and storing the guide commands in the respective storage devices of the individually guided bombs; the step of utilizing the stored guide commands to guide the respective bombs and responsive to simultaneous release of the bombs from the carrier aircraft, independently of each other into different respective trajectories so that the bombs strike the target area in a predetermined coverage density corresponding to the selected target coverage pattern.

2. A method of spread bombing, as claimed in claim 1, wherein the carrier aircraft is provided with a weapon computer; the steps of adjusting the selected different respective guide programs on the ground prior to an attack on a target area; utilizing the weapon computer to bring the carrier aircraft into a flight position predeterminable by the weapon computer; and, in the flight position, utilizing the weapon computer to release the guided bombs simultaneously.

3. A device for spread bombing utilizing a plurality of guided bombs, with respective programmable storage devices, transported by a carrier aircraft near to a target area and simultaneously released from the carrier aircraft to utilize stored guide commands signals to guide the respective bombs independently of each other into different respective trajectories so that the bombs strike the target area in a predetermined coverage density corresponding to a selected target coverage pattern provided by selected different respective guide program signals simultaneously supplied to the storage devices and transformed into guide command signals stored in the respective storage devices of the individually guided bombs, said device comprising, in combination, a respective connector for each guided bomb; respective rudders on each guided bomb controlling the curvature of the respective trajectory and the plane of such curvature; respective storage elements on each guided bomb receiving enterable, critical measured control signals; respective power accumulators operable to return each rudder to the neutral position for ballistic flight of the associated guided bomb; and switches operatively associated with said power accumulator and released as soon as the entered measured control signals are attained by the associated guided bomb for operation of the power accumulators to return the rudders to the neutral position for such ballistic flight of the associated guided bomb.

4. A device, as claimed in claim 3, including a weapon computer carried by the carrier aircraft; said weapon computer providing output signals through which the control programs for the guided bombs, in the form of critical measured control signals at which the rudder deflections of the guided bombs are to be nullified, are determined from the respective actual measured control signals and the desired coverage about the target area.

* * * * *